US006030697A

United States Patent [19]

Samson et al.

[11] Patent Number: 6,030,697

[45] Date of Patent: Feb. 29, 2000

[54] METHOD OF IMPREGNATING GARMENTS WITH AN INSECTICIDE

[75] Inventors: Richard D. Samson; James M. McKinney, both of North Augusta, S.C.

[73] Assignee: Avondale Mills, Inc., Sylacauga, Ala.

[21] Appl. No.: 08/885,039

[22] Filed: Jun. 30, 1997

[51] Int. Cl.[7] ..... B32B 7/02

[52] U.S. Cl. ..... 428/221; 428/907; 427/248.1; 427/265; 427/322.2; 427/240; 427/242; 427/412; 427/370

[58] Field of Search ..... 428/240, 252, 428/264, 907, 265, 221; 424/125, 463, 403; 427/322.2, 324, 240, 242, 370, 417, 412, 393.3, 248.1, 265; 135/115

[56] References Cited

U.S. PATENT DOCUMENTS

| | | | |
|---|---|---|---|
| 4,758,465 | 7/1988 | McKinney et al. | 428/252 |
| 5,057,539 | 10/1991 | Noekom et al. | 514/531 |
| 5,089,298 | 2/1992 | McNally et al. | 427/240 |
| 5,198,287 | 3/1993 | Samson et al. | 428/248 |
| 5,252,387 | 10/1993 | Samson et al. | 628/248 |
| 5,503,913 | 4/1996 | Samson et al. | 628/248 |
| 5,631,072 | 5/1997 | Samson et al. | 462/125 |

*Primary Examiner*—Merrick Dixon
*Attorney, Agent, or Firm*—Schweitzer Cornman Gross & Bondell LLP

[57] ABSTRACT

A plurality of garments are impregnated with an effective amount of permethrin to provide protection against insects by use of a combination of an industrial washing machine and holding tank containing permethrin solution of predetermined strength. The permethrin solution is pumped through the washing machine during washing and returned to the holding tank after the wash cycle is completed. The process is repeated as often as needed. Extracted liquid resulting from a spin cycle to dry the garments after washing may also be circulated to the holding tank and ultimately recirculated.

7 Claims, 1 Drawing Sheet

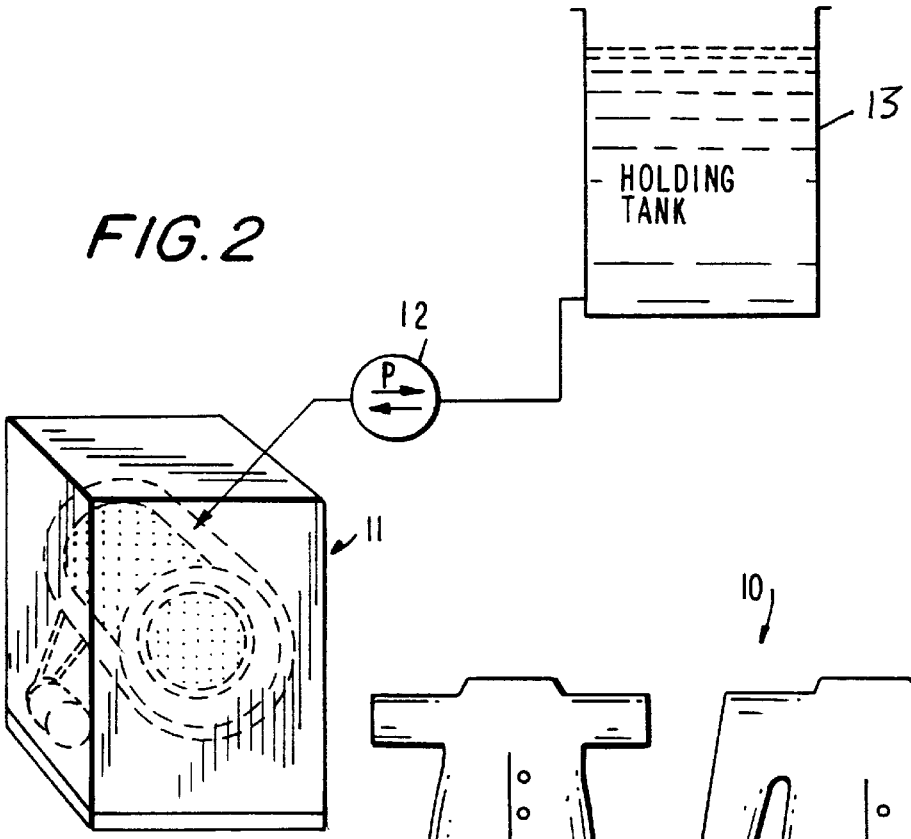
FIG. 2
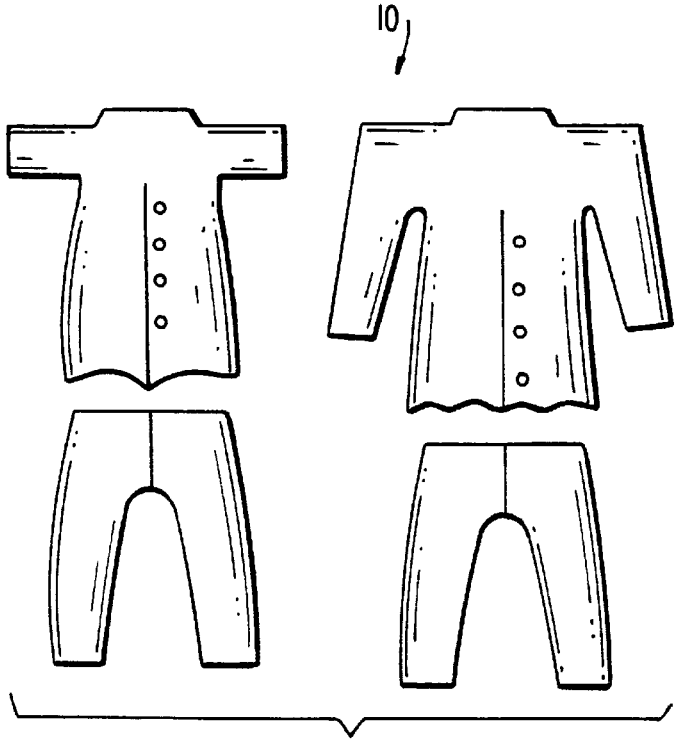
FIG. 1
FIG. 3
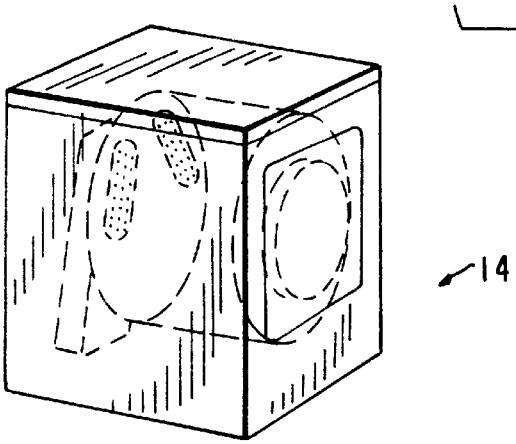

METHOD OF IMPREGNATING GARMENTS WITH AN INSECTICIDE

FIELD OF THE INVENTION

This invention relates to the treatment of finished garments, such as Battle Dress Uniforms (BDUs), to repel insects by simultaneously impregnating a plurality of garments, before or after they are worm, with an insecticide, such as permethrin.

BACKGROUND OF THE INVENTION

Permethrin is widely recognized as an effective insecticide. It is also widely known that the effectiveness of permethrin diminishes with its exposure to oxygen and ultra-violet rays. Permethrin is used on fruit and vegetable crops for control of insects and is toxic to fish and bees. It is, however, one of the least toxic insecticides to humans and animals.

As a precaution to the health of humans who use permethrin-treated garments for protection against insects, the Environmental Protection Agency limits the amount of permethrin in clothing outerwear to 1.25 grams of permethrin per square meter of fabric. The United States government uses this limited amount of permethrin in selected BDUs for the protection of its troops against disease-bearing insects.

The following description of permethrin and its uses is comprised of excerpts from *Health Effects of Permethrin-Impregnated Army Battle-Dress Uniforms*, a publication published in 1994 by National Academy Press, Washington, D.C. on the health assessment of wearing BDUs impregnated with permethrin. The assessment was prepared in the National Research Council by a Subcommittee to Review Permethrin Toxicity from Military Uniforms. The assessment found that:

1. "More active military service days have been lost to diseases—many of them transmitted by insects—than to combat."

2. "Controlled experiments in the laboratory and with human volunteers in the field show that clothing impregnated or sprayed with permethrin offers reliable protection against a wide range of vector insects and arthropods, such as mosquitoes, human body lice, tstse flies, and ticks, including *Ixodes dammini*, the principal vector of Lyme disease and human babesiosis in the United States."

3. ". . . the U.S. Army has proposed using permethrin as a clothing impregnant in battle-dress uniforms (BDUs) to kill or repel insects, ticks, and mites."

4. "To adjust for actual exposure conditions, it was assumed that military personnel would wear the permethrin-treated BDUs 18 hr per day for 10 years during a 75-year lifetime."

5. "Adjusting for the proportion of lifetime exposure resulted in a calculated average daily life time dose of $6.8\times10^{-5}$mg/kg per day."

6. "The average daily lifetime internal dose for garment workers was calculated to be $3.0\times10^{-5}$ mg/kg bpdy per day less than half the daily dose calculated for military personnel."

7. ". . . soldiers who wear permethrin-impregnated BDUs are unlikely to experience adverse health effects at the suggested permethrin exposure levels (fabric impregnation concentration of 0.125 mg/cm$^2$)."

8. "Treatment at the approved dosage remains effective through 35 launderings of the uniform (i.e., beyond the combat life of the uniform) but can be removed by dry cleaning (U.S. Army, 1993)."

9. "According to the U.S. Army, application of permethrin to the BDU cloth at the time of manufacturing provides the most consistent treatment at the approved dosage and will relieve soldiers from the burden of treating BDUs."

10. "EPA-registered aerosol cans of 0.5% permethrin are used by all services."

11. "Initial spraying of a BDU with the aerosol formulation provides a permethrin dosage approximately equal to that of an impregnated uniform that has been washed 25 times."

12. "The Army Clothing and Equipment Board has recommended factory permethrin treatment of all desert BDUs, which are worn by soldiers in such deployments as the Gulf War or by field units in rapid deployments."

Unpatented Prior Art

Faced with the need for protecting the troops and with the need for human and environmental safety, the U.S. Army Engineering & Support Center in Huntsville, Ala. contracted with Foster Wheeler Environmental Corporation, 1290 Wall Street West, Lyndhurst, N.J. 07071, to prepare a document with a title page containing the format and information hereinbelow.

"US Army Corps of Engineers
Huntsville Division

Draft Final

Battle Dress Uniform Pesticide

Pretreatment Environmental Assessment

Lead Agency - Defense Logistics Agency

Department of Defense

Cooperating Agencies

U.S. Army Corps of Engineers (CEHNC-PM-ED)

U.S. Army Medical Research and Material Command (MCMR-RCQ-E)

U.S. Army Soldier Systems, Command, PM Soldier (SSCPM-LM)

Contact for Further Information:

Steve Sadler

Defense Logistics Agency

ATTN: DLA-MMSB

Cameron Station

Alexandria, Va. 22304-6100

Contract Number DACA87-94-D-0020 Delivery Order 0004 (Annex E)

This draft program environmental assessment addresses the potential consequences to the human environment resulting from the factory pretreatment of battle dress uniforms with permethrin. The proposed pretreatment (sic) option is compared to no pesticide treatment and several methods of mechanical and pesticide field treatment currently available.

May 1996

Prepared by

FOSTER WHEELER ENVIRONMENTAL CORPORATION

Under Contract to

Department of the Army, US Army Engineering & Support Center, Huntsville"

Table 1 on page 4 of Foster Wheeler's *Battle Dress Uniform Pesticide Pretreatment Environmental Assessment* (the BDU Pesticide Assessment) lists eight methods of applying to BDUs the amount of permethrin permitted by the Environmental Protection Agency:

1. Individual Dynamic Absorption Application (IDAA) Kits.
2. Two Gallon Field Sprayer.
3. Aerosol Spray Can.
4. Aerosol Hand-Held Sprayer.
5. Thirty-two Gallon Can/Field Immersion.
6. Field Laundry.
7. Pad Roll.
8. Hot Dye Bath.

The first six methods are used in the field. Only the last two methods (pad roll and hot dye bath) are used in factories to apply permethrin to fabric to be made into garments Pages 6–7 of the *BDU Pesticide Assessment* describe the pad roll method as involving the pretreatment of cloth during its manufacture. The fabric is passed through a permethrin/water bath in a padder, with a target application concentration of 0.125 mg/cm$^2$. The cloth is then sent through squeeze rolls and dried.

Advantages of the pad roll method are (1) this pretreatment is expected to last over the lifetime of the garment, approximately two years; (2) application of permethrin by the pad roll method ensures consistent treatment of the fabric; and (3) the pad roll method is relatively low in cost.

The hot dye bath is described at pages 15–16 of the *BDU Pesticide Assessment* as another industrial method of applying permethrin. The raw fabric is saturated with a permethrin/water formulation bath and passed through a mechanical wringer, a rinse solution and then a second wringer. The cloth is stretched and heat dried. It has proven difficult to attain the target impregnation rate, requiring high concentrations of permethrin. It is also necessary to acidify the solution to increase uptake, which weakens the fabric. Field studies indicate that the hot dye bath method is impracticable and incompatible for treating fabric intended for BDUs.

The sixth method, *Field Laundry*, is described at page 14 of the *BDU Pesticide Assessment* as a method of applying permethrin to BDUs in a standard field laundry unit, described as follows at page 14:

> In the field laundry treatment method, BDUs are placed into a standard field laundry washer at 100° F. and the permethrin/water formulation (along with glacial acetic acid for the 50/50 nylon/cotton fabric only) is added. The washer is run for five minutes at 140° F., and then continued at 170° F. for an additional sixty minutes. The BDUs are rinsed well and hung to dry. The field laundry was inefficient impractical, and costly during testing. The method results in unpredictable and non-uniform applications, with concentrations below the target level of 0.125 mg/cm$^2$, Less than 20 percent of the permethrin in the water bath deposits on the BDU fabric. Due to this unpredictability, standard amounts of permethrin for application in the process cannot be developed. In addition, no drums, barrels or pots are available at the field laundries in which to do a large-scale treatment.
>
> Field laundries are rarely used in peacetime and the laundry units are generally in crates ready for emergency shipment only. Personnel at the field laundries would be negatively impacted if treatment were to occur there.
>
> While the solid waste concerns in using this field method are not as great as with individual treatment methods, the potential for permethrin loss to the environment may be high. Only 20 percent of the pesticide in the treatment water bath is deposited onto the BDUs. Improper disposal of the water could result in impacts to aquatic invertebrate, insect and other species and contamination of local water bodies. (Emphasis added).

Notwithstanding the disappointing results obtained in field laundries, the addition of permethrin to BDUs in an industrial washing machine, according to the present invention, consistently results in the application of permethrin to successive loads of garments at the target level of 0.125 mg/cm$^2$, and without any loss of permethrin to the environment.

The Patented Prior Art

The patented prior art discloses several ways of applying permethrin to fabric. See, for example:

U.S. Pat. No. 5,089,298 issued Feb. 18, 1992 to McNally et al. for SYNERGISTIC EFFECT OF AMYLOPECTIN-PERMETHRIN IN COMBINATION ON TEXTILE FABRICS;

U.S. Pat. No. 5,198,287 issued Mar. 30, 1993 to Samson, et al. for INSECT REPELLENT TENT FABRIC;

U.S. Pat. No. 5,252,387 issued Oct. 12, 1993 to Samson et al. for FABRICS WITH INSECT REPELLENT AND A BARRIER;

U.S. Pat. No. 5,503,918 issued Apr. 2, 1996 to Samson et al. for METHOD AND MEANS FOR RETAINING PERMETHRIN IN WASHABLE FABRICS; and U.S. Pat. No. 5,631,072 issued May 20, 1997 to Samson et al. for METHOD AND MEANS FOR INCREASING EFFICACY AND WASH DURABILITY OF INSECTICIDE TREATED FABRIC.

All of the foregoing patents, except U.S. Pat. No. 5,089,298 to McNally et al., teach the application of permethrin to fabric at the factory making the fabric, before the fabric is formed into garments. Only the McNally patent teaches the application of permethrin to fabric after the fabric has been formed into a garment.

The manufacturers of BDUs and other garments have expressed concern that the toxic nature of permethrin endangers the health of those workers who are exposed to permethrin over a period of time by making garments from permethrin-treated fabric day in and day out. This concern has generated interest in manufacturing garments, such as BDUs, in the usual manner and putting permethrin in selected garments after they are manufactured.

McNally, et al. teaches the application of permethrin to individual Battle Dress Uniforms (BDUs) by the Individual Dynamic Absorption Application (IDAA) procedure. The IDAA enables military personnel to treat their own BDU with relatively simple equipment and in emergency situations.

McNally teaches in column 3, beginning in line 16, that it is not advisable to add permethrin to a laundry cycle:

> since such an application of Permethrin into the machine would constitute a waste of the Permethrin and, more important, could create a potentially dangerous effluent that might find its way to a stream or other places inhabited by fish.

According to the present invention, permethrin is consistently added to successive loads of BDUs in an industrial washing machine at the target rate of 1.25 grams of permethrin per square meter of textile material (1.25 $g/m^2$ permethrin). The permethrin is consistently added to the garments in this manner without endangering the environment.

SUMMARY OF THE INVENTION

This invention comprises a method of simultaneously and reliably impregnating a plurality of garments, such as BDUs, made from conventional fabric with an effective amount of permethrin to provide protection against insects.

The garments are impregnated with permethrin by placing a plurality of fully completed garments in an industrial washing machine and washing the garments in a permethrin solution of predetermined strength.

Initially, steps are taken to determine the amount of permethrin that is needed to put in the washing machine to result in the fabric of the garments absorbing no more than the Environmental Protection Agency's target amount of 1.25 grams of permethrin per square meter of fabric (1.25 $g/m^2$ permethrin). After determining the amount of permethrin to be used, that amount of permethrin is mixed with a suitable amount of water in a holding tank. The garments are then loaded into an industrial washer having a rotatable drum. The permethrin solution of predetermined strength is pumped from the holding tank to the washer for a wash cycle. After the wash cycle, the permethrin solution is pumped from the washer back to the holding tank. The garments in the washer are then subjected to a spin cycle to remove excess permethrin solution from the garments. The extracted liquid is also pumped to the holding tank. The garments are then dried in conventional tumble dryers, and the process is repeated as often as needed.

Tests have shown that successive loads of garments can be treated in this fashion and each garment will reliably contain permethrin within the maximum allowance of 1.25 $g/m^2$ permethrin, established by the Environmental Protection Agency.

BRIEF DESCRIPTION OF THE DRAWINGS

FIG. 1 is a schematic view of a plurality of garments, manufactured in a conventional manner, to be treated with permethrin;

FIG. 2 is a schematic view of an industrial-size washing machine communicatively connected with a holding tank for a solution of permethrin of predetermined strength; and FIG. 3 is a schematic view of an industrial-size tumble dryer.

DETAILED DESCRIPTION OF THE INVENTION

According to the invention, permethrin is added to a plurality of garments, broadly indicated at 10, in an industrial washing machine 11, but before either the garments or the permethrin is put in the washing machine, the fabric of the garments is examined to determine the amount of permethrin to be used for the garments to absorb no more than 1.25 grams of permethrin per square meter of fabric, the target rate of permethrin established by the Environmental Protective Agency. As used herein the term "garments" includes but is not limited to Battle Dress Uniforms (BDUs).

It is known that different types of fabric absorb different amounts of liquid. The percentage of absorption is based on dry fabric weight, and the absorption process is commonly referred to as wet percent pick-up in the textile trade. Twill fabric is commonly used in BDUs and other garments and will be used as an example in describing the invention.

EXAMPLE

The permethrin used in this example is PERMANONE 40, having 40% permethrin as an active ingredient. PERMANONE 40 is manufactured by AgrEvo, a company of Hoechst and Schering in Berlin, Germany and having a place of business known as AgrEvo Environmental Health at 95 Chestnut Ridge Road, Montvale, N.J. 07645.

PERMANONE 40 is an emulsifiable concentrate that is cut with water to get the amount of permethrin needed for the type and weight of fabric in like garments to be treated. As used herein, the term "like garments" means garments of the same style, such as BDUs.

The first step in practicing the invention is to determine the weight of the fabric used in making like garments that are to be treated with permethrin. Twill fabric weighs 247.47 grams per square meter. One test sample of the like garments to be treated with permethrin is weighed. The test sample weighs 1,405 grams when dry. The test sample is then put in a wash cycle run for five minutes and stopped. The liquid is pumped from the washer and a spin cycle is applied for ten minutes with the extractive liquid removed by a pump 12. The test sample is removed and weighed while wet. The weight increased from 1,405 grams dry weight to 2,073 grams wet weight.

The formula weight applied to the test sample is the difference between the 2,073 grams wet weight and the 1,405 grams dry weight, or 668 grams. The wet percent pickup can then be obtained by dividing the dry weight of the test sample (1,405 grams) into the formula weight (668 grams). 668÷1,405=47.54 wet percent pickup of the test sample.

The formula deposition will be 47.54% of the dry weight of the fabric (247.47 grams per square meter in the test sample), or 117.65 grams per square meter. The total formula deposition is 117.65 grams per square meter, but the target deposition of permethrin on the fabric is only 1.25 grams per square meter of fabric. The percentage of permethrin needed to get the target deposition of 1.25 grams of permethrin per square meter of fabric is obtained by dividing the formula deposition of 117.65 grams of permethrin into the target deposition of 1.25 grams of permethrin. 1.25÷117.65=1.06%.

The formula consists of only permethrin and water. Having determined that 1.06% of the formula is permethrin, it follows that 98.94% of the formula is water; thus the formula for this example is 98.94 pounds of water and 1.06 pounds of permethrin. Using the commercially available PERMANONE 40, with its 40% concentration of permethrin, the formula in this example is 97.35 pounds of water and 2.65 pounds of PERMANONE 40.

Continuing the example, a holding tank 13 is filled with a solution containing 97.35 pounds of water and 2.65 pounds of PERMANONE 40. The washing machine 11 is a Milnor industrial washer having a drum D. The washer 11 is filled with like garments 10, made from twill fabric weighing 247.47 grams per square meter. The pump 12 moves an adequate supply of permethrin solution from the holding tank 13 to the washer 11.

A wash action cycle is run for five minutes, then stopped. The permethrin solution extracted from the garments is returned by the pump 12 to the holding tank 13. The garments 10 in the washer 11 are subjected to a spin cycle for ten minutes to extract liquid from the garments. The garments are then removed from the washer and dried in a conventional tumble dryer 14. The liquid extracted from the garments is removed from the washer 11 by the pump 12 and returned to the holding tank 13, where it remains until pumped back to the washer to impregnate more like garments with the target amount of permethrin.

There is thus provided a novel method of reliably impregnating finished garments at the factory with the target amount of permethrin approved by the EPA, thereby effectively providing protection from insects to the wearers of the garments. This protection is provided without endangering the environment, and without exposing the garment workers to any deleterious effects of permethrin.

Although specific terms have been used in describing the invention, they have been used in a descriptive and generic sense only and not for the purpose of limitation.

We claim:

1. In a system for impregnating garments with an effective amount of permethrin to provide protection against insects, using a washing zone and a liquid holding zone, the improved process which comprises:

(1) mixing permethrin and water in the liquid holding zone to form a treating solution sufficient to impregnate the garments with the desired amount of permethrin, (2) loading said washing zone with garments to be treated, (3) transferring said treating solution from said holding zone to said washing zone, (4) washing said garments in the washing zone in the presence of said treating solutions, and then (5) after washing of garments is completed, transferring the treating solution back to the holding zone.

2. The process of claim 1 which further comprises spin drying the washed garments thereby recovering further amounts of treating solution, and transferring said recovered treating solution to the holding zone.

3. The process of claim 1 where an additional amount of the same type of garments are treated by repetition of the process of claim 1.

4. The process of claim 1 wherein the amount of permethrin impregnating said garments is no more than 1.25 grams of permethrin per square meter of fabric, but sufficient to protect the wearer against disease-bearing insects.

5. The process of claim 1 wherein said garments are battle-dress uniforms (BDUs).

6. The process of claim 1 wherein said garments are rotated in said washing zone to insure proper impregnation with treating solution.

7. The process of claim 1 wherein the treating solution contains about 1 weight percent permethrin, the balance being water.

* * * * *